United States Patent [19]

Wallstén

[11] 4,076,865

[45] Feb. 28, 1978

[54] METHOD AND APPARATUS FOR COATING BOTH SIDES OF A MOVING WEB, USING BLADES

[75] Inventor: Hans Ivar Wallstén, Lausanne, Switzerland

[73] Assignee: Inventing S.A., Lausanne, Switzerland

[21] Appl. No.: 717,383

[22] Filed: Aug. 24, 1976

[30] Foreign Application Priority Data

Aug. 26, 1975 Sweden ..... 7509460

[51] Int. Cl.[2] ..... B05D 3/12

[52] U.S. Cl. ..... 427/209; 427/211; 427/356; 427/361; 118/404; 118/405; 118/407; 118/413

[58] Field of Search ..... 118/404, 405, 407, 413; 427/209, 211, 356, 361

[56] References Cited

U.S. PATENT DOCUMENTS

| | | | |
|---|---|---|---|
| 3,070,066 | 12/1962 | Faeber | 118/413 |
| 3,484,279 | 12/1969 | Clark et al. | 427/356 |

*Primary Examiner*—Michael R. Lusignan
*Attorney, Agent, or Firm*—Louis Weinstein

[57] ABSTRACT

A method and apparatus for coating both faces of a moving web, such as a paper web in which the web is fed longitudinally at a speed in excess of 200 meters per minute and a coating material is applied to each face of the web, and is smoothed out by means of two blades, one on each face of the web. The blades are formed with a bevel at the point of contact with the web, the width of this bevel measured in the direction of movement of the web is at most 0.08 centimeters and the angle of the blade with respect to the web is less than 25°. Preferably the blades are urged against the web with a force not exceeding 0.20 kgf. per centimeter width of web.

9 Claims, 10 Drawing Figures

METHOD AND APPARATUS FOR COATING BOTH SIDES OF A MOVING WEB, USING BLADES

BACKGROUND OF THE INVENTION

The present invention relates to a method and apparatus for coating both sides of a moving web, such as a paper web, moving at a rate in excess of 200 m/min, whereby the same or two different coating agents are applied simultaneously to each side of the web and the coating agent thus applied is smoothed out by means of two opposing blades each having a bevelled edge acting on the web.

Several different methods and apparatus operating with two opposing, flexible blades are already known for simultaneously coating both sides of a paper web. In one known proposal the paper web is passed from the top downwardly, a bath of coating compound being contained in the space formed between the opposing blades with their holders. These blades form an acute angle to the direction of movement of the web.

In other known embodiments the paper web is passed substantially vertically upwards, the smoothing effect being obtained by means of two opposing blades which in this case also form an acute angle to the direction of movement of the web. The embodiments mentioned above have the advantage that because of the forces of gravity prevailing the excess coating compound can be recirculated in the equipment. Due to the hydraulic forces occurring resulting from the moderately vigorous movement in the coating compound during the coating process, a force is obtained on the coating blades which counteracts the spring force of the blades themselves when they are pressed against the paper web.

Regulation of the final quantity of coating compound applied is therefore dependent on the pressure exerted by the blades upon each other. This pressure can be effected in various ways. At high speeds of the web and/or high viscosity of the coating compound, the increased hydraulic pressure on the blades must be compensated by an increased pressure on the blades so that the desired application quantity is obtained.

In known arrangements for coating using two opposing blades, the paper web does not have a movable support such as a rotating roller, as in the case of traditional blade coating. There is therefore a greater risk of defects in the coating or breakages in the paper web caused by particles in either the coating compound or the paper web catching between one or both coating blades and the moving paper web. Particles caught in this way may easily result in longitudinal lines in the coating layer (so-called streaks) so that the coated paper must be rejected or, if the particles are large or sharp the web may be perforated and a rupture may occur.

This drawback is inherent in conventional means for coating with two opposing blades and increases with increasing web speeds and/or high dryness contents or viscosities of the coating compound. It has been found, for instance, that when using traditional steel blades suitable for blade coating in traditional thicknesses (0.30 – 0.60 mm), it is impossible to achieve an acceptable result with respect to rejection and production at web speeds above 150 – 200 m/min.

BRIEF DESCRIPTION OF THE INVENTION

According to the present invention there is provided a method of coating both faces of a moving web, such as a paper web, comprising feeding the web longitudinally at a speed in excess of 200 meters per minute, applying a coating material to each face of the web, smoothing the coating material by means of two blades, one on each face, said blades each having a bevel at the point of contact with the web, controlling the angle of the blades so that they each extend at an angle less than 25° to the web and choosing the bevel width, measured in the direction of movement of the web, to be at most 0.08 centimeters.

The invention also provides apparatus for coating both faces of a moving web, such as a paper web comprising means for moving the web at a speed in excess of 200 meters per minute, means for applying coating material to both faces and two blades, one on each face of the web, for smoothing out the coating material, the blades having a bevel at the point of contact with the web, the bevel width, as measured in the direction of movement of the web, being at most 0.08 centimeters.

BRIEF DESCRIPTION OF THE FIGURES

In order that the invention will be better understood, the following description is given, merely by way of example, reference being made to the accompanying drawings, in which.

DETAILED DESCRIPTION OF THE INVENTION AND ALTERNATIVE EMBODIMENTS THEREOF

Figure 1:
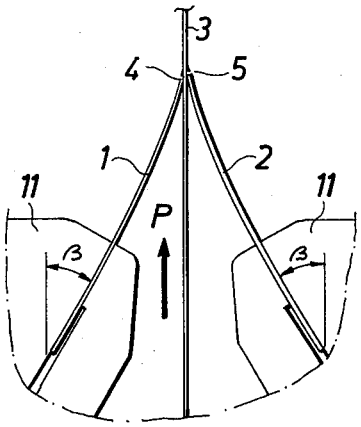
FIGS. 1 to 5 are schematic side elevations illustrating known forms of apparatus and FIGS. 6 to 10 are similar views of apparatus according to the invention.
Figure 2:
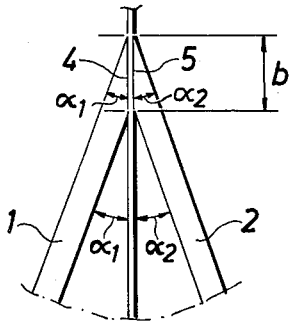

FIG. 1 illustrates the familiar principle of how two opposing blades act. The blades are designated 1 and 2, respectively and the paper web, in this case moving upwardly in the direction of the arrow P, is designated 3. Each blade 1, 2 has a bevel or working surface 4 and 5, respectively. FIG. 2 is an enlarged detail of FIG. 1. The so-called blade edge angle, i.e. the angle between the bevel 4, 5 and the blade 1, 2 has been designated $\alpha 1$ and $\alpha 2$. The width of the bevel 4, 5 is designated b and in FIG. 2 it has been assumed for the sake of simplicity that both bevels 4, 5 have the same width b.

It should be pointed out here that said bevels 4,5 are preferably obtained by grinding so that a suitable blade edge angle $\alpha$ is obtained. If the blades 1, 2 are not too thick and not pre-ground, however, bevels 4, 5 corresponding to those shown in FIG. 2 will be formed after a certain period of running due to wear.

The blades 1, 2 are arranged in individual blade holders 11. The blade holder 11 in FIG. 1 also forms an angle in relation to the paper web 3. The angle between the centre line of the blade holder 11 and a vertical line has been designated $\beta$ and will be referred to subsequently as the blade holder angle. It is easily understood that if the paper web 3 moves upwardly, the blade holder angle $\beta$ will always be greater than the blade edge angle $\alpha$ because of the flexing of the blade.

Figure 3:
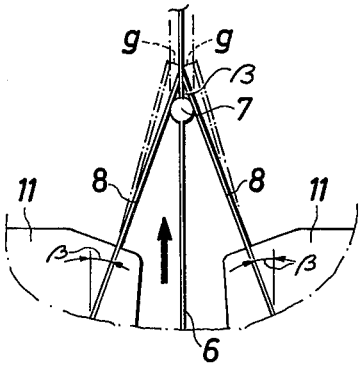
Figure 4:
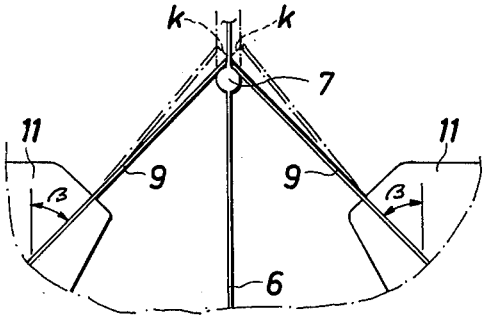
Figure 5:
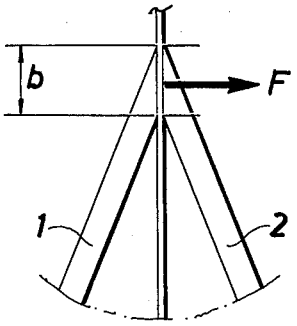

FIGS. 3, 4 and 5 show in principle and extremely schematically the significance of the blade edge angle $\alpha$. It has been assumed in this instance for the sake of simplicity that the blades 1, 2 are not flexible.

In FIG. 3 the paper web has been indicated by the line 6. A particle 7 shown as being circular is assumed to have caught in the paper web against the blades 8. Since, as mentioned, it is assumed that the blades 8 are straight, the blade edge angle and the blade holder angle will be the same and are therefore designated $\beta$. FIG. 3 shows a case in which the blade edge angle is relatively acute. When the particle 7 is carried along with the paper web in its upward movement it will come into contact with the opposing blades 8. If the particle 7 is adhered to the paper web 6 sufficiently firmly the blades 8 will part so that the particle 7 is permitted to pass up between the blades 8. The blade edges will therefore move away from the paper web until the particle 7 has passed both blades 8, whereupon the blades 8 will for an instant assume the position indicated by broken lines in FIG. 3. The distance which each blade edge must move in order to give free passage to the particle 7 has been designated g.

FIG. 4 illustrates extremely schematically a case in which two opposing blades 9 form a considerably more obtuse blade edge angle than the blades 8 in FIG. 3. Here also it is assumed that the blades 9 are straight and have the same free length measured from the blade holder 11 to the edge of the blades as the blades 8 in FIG. 3. If particles 7 of the same size and under the same conditions otherwise pass between the blade edges of the blades 9 in FIG. 4 they will again be forced apart. The distance they must move in this case has been designated k in FIG. 4.

Assuming that all factors are the same in the two cases illustrated in FIGS. 3 and 4 except for the blade edge angles, the risk of a particle 7 becoming lodged between the blade edges is considerably greater in the embodiment of FIG. 4 than in that of FIG. 3.

The reason for this is that in the apparatus according to FIG. 4 the blades 9 must be moved a considerably greater distance k than the blades 8 in the apparatus according to FIG. 3 where this distance is designated g. However, the distance from when the particle 7 comes into contact with respective points on the opposing blades 8 and 9, until the particle has passed between the opened blades, is also considerably shorter in the means according to FIG. 4. This means that the arrangement according to FIG. 3 is considerably more favourable in view of its wedge action, that is to say, particles and other defects can pass considerably more easily between the opposing blade edges under otherwise similar conditions.

It is clear from the above that the spring force with which the blades press against each other is also of considerable importance with respect to the risk of rupture and streaks. The greater this spring force is, the greater the effort required to permit passage of the particle, i.e. the greater the risk of defects or rupture.

As mentioned, the spring force is used to regulate the quantity applied. At low web speeds and/or coating with low-viscosity coating compounds low spring force may be used. However, when coating at higher web speeds, a considerably greater hydraulic pressure occurs since the coating compound present in the nip between the paper web and the blade edges is caused to move more vigorously during the coating process. These hydraulic forces counteract the spring force of the blades themselves. At higher web speeds and/or higher viscosities of the coating compound, therefore, the spring force must be increased to compensate the increased hydraulic pressure so that the desired quantity of applied coating is obtained on the web. It is not sufficient merely to increase the spring force mechanically by placing the two blade holders closer together and in methods used so far thicker blades and/or shorter clamping lengths for the blades have been resorted to.

Table 1 shows certain values measured during operation of a known means operating in accordance with the method described in Swedish Patent No. 301,287 corresponding to U.S. Pat. No. 3,930,464. Blades and blade holders are arranged as shown in FIG. 1. FIG. 5 also shows schematically a detail from FIG. 1 with two opposing blades. The bevel width has been designated *b* and the spring force, or the total force per width unit measured in the transverse direction of the web from the blade 1 is indicated in the form of an arrow F. The specific pressure or surface pressure from the blade is defined as the quotient of the force F and the bevel width b ((F/*b*). "Free blade length" is intended to mean the distance along the blade measured from the clamping point in the blade holder to the blade edge. The values for F given in Table 1 are based on measurements in a specially arranged simulator.

TABLE 1

| Example no. | | | 1 | 2 | 3 |
|---|---|---|---|---|---|
| free blade length | | mm | 40 | 40 | 35 |
| blade thickness | t | mm | 0.31 | 0.38 | 0.38 |
| spring force | F | kgf/cm | 0.045 | 0.084 | 0.11 |
| bevel width | b | cm | 0.12 | 0.14 | 0.14 |
| blade edge angle | | o | 20 | 20 | 20 |
| spec. pressure | F/b | kgf/cm$^2$ | 0.38 | 0.60 | 0.79 |
| dryness content of compound | | % | 55 | 55 | 55 |
| viscosity of compound | | centipoise | 1000 | 1000 | 1000 |
| web speed | | m/min | 100 | 150 | 200 |
| quantity applied | | g/m$^2$ and side | 12 | 12 | 12 |

As can be seen from Example 1 in Table 1 the blade thickness is 0.31 mm, the blade edge angle 20° and the free blade length 40 mm. With these values it was possible to obtain a quantity applied of 12 g/m$^2$ on each side and a satisfactory coating result at a web speed of 100 m/min. Example 2 shows coating with the same coating compound at a speed of 150 m/min. Because of the higher hydraulic pressure a greater spring force is required to maintain the desired quantity applied. In Example 2 this has been achieved by using a thicker blade. As can be seen, the spring force is thereby substantially doubled. The bevel width has also been increased slightly.

Example 3 shows coating at a web speed of 200 m/min. In this case the requirement for additional spring force has been fulfilled by reducing the free blade length to 35 mm. The spring force is thus increased to 0.11 kgf/cm$^2$.

However, it has been found that the spring force cannot be increased further at web speeds above 250 – 300 m/min. In practice, therefore, there is an upper limit, as will be explained below.

Although the spring force in the examples shown in Table 1 is extremely low in relation, for instance, to traditional blade coating apparatus in which the spring force is often at least ten times greater, it has been found in practice, in accordance with the present invention, that the spring force should preferably not exceed 0.15 kgf/cm$^2$ and should under no circumstances exceed 0.2 kgf/cm$^2$. With greater spring forces the streak and rupture frequency is too great to be commercially acceptable. This is particularly so when coating thin or weak paper. Particularly at the moment of starting, i.e. when the blades come into contact with the paper web and the coating compound has perhaps not had time to completely fill the appropriate space, considerable strain will occur since the hydraulic force has not been fully developed and cannot therefore counteract the spring force. If the spring force is too great, this strain may cause a rupture in the web.

Furthermore, a relatively thick blade with relatively short clamping length has poor flexibility. By "flexibility" is meant the so-called spring constant or spring ratio which is defined as the ratio between a change in load at the free end of the blade and the change in position caused thereby. It is desirable for the blades to have a certain flexibility to combat sudden variations caused by defects in the paper web. Good flexibility also contributes to the elimination of irregularities in the blade holder members across the web. Good flexibility is also required to prevent the occurrence of streaks running transversely across the paper web. Such streaks can occur when a defect passes the nip between the blade edges, urging them apart, so that a stripe of excess coating compound occurs. If the blades are flexible such stripes can be eliminated, whereas with poor flexibility the stripes will be wide and the web will have to be rejected. As is known, the flexibility is dependent on the elasticity modulus of the material, clamping length and manner of clamping and also on the thickness of the blade.

It can be seen in Table 1 that the blade edge angle has been 20°. It has been mentioned earlier that the blade edge angle should be acute when coating with two opposing blades in order to achieve good wedge action so that the risk of rupture and streaks is avoided. In practice it has been found that the blade edge angle should not exceed 20° – 22° and under no circumstances 25°. Instead a blade edge angle of less than 20° is to be preferred.

As a result of extensive experiment it has been ascertained that the quantity applied is to a great extent dependent on the specific pressure during coating under otherwise identical conditions, i.e. the higher the specific pressure the less the quantity applied.

FIGS. 6, 7, 8, 9 and 10 show a number of embodiments of the invention.

Figure 6:
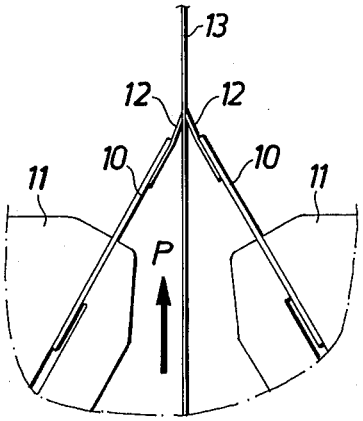

In FIG. 6 the opposing blades consist of a thicker, blade section 10, preferably consisting of a relatively rigid blade. Each blade 10 is clamped in a blade holder 11. To each blade 10 a more flexible thin blade 12 is secured in suitable manner, this thin blade having a blade edge angle of less than 20°. The paper web is designated 13. In the apparatus illustrated in FIG. 6 the great flexibility is obtained by the blade sections 12 being thin and flexible and since, due to this slimness, a high specific pressure is achieved.

Figure 7:
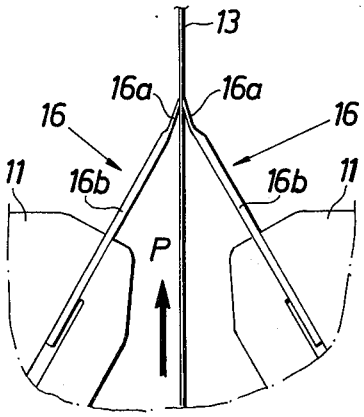

In the embodiment according to FIG. 7 a similar effect is achieved by using two opposing blades 16, each manufactured in one piece, and by means of suitable machining acquiring a profile with an upper, relatively flexible, thin blade section 16*a* and a lower, relatively rigid, thick blade section 16*b*. It can easily be understood that in the embodiment according to FIG. 7 a similar effect to that in the embodiment according to FIG. 6 can be obtained. The paper web has been designated 13 in FIG. 7 also and runs in the direction of the arrow P.

Figure 8:
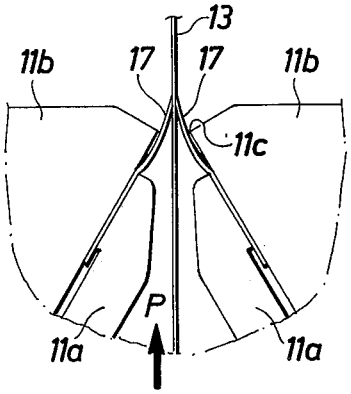

FIG. 8 shows another embodiment of the invention. Here relatively great specific pressure is achieved by using thin blades 17 which therefore have a small bevel width. In this case blades 17 are used which have uniform thickness and are slim. However, an ordinary blade holder cannot be used since such slim, homogeneous blades must be relatively short. If blade holders with collet jaws having the same length as in the embodiment according to FIG. 6 were to be used, at an increase in force at higher speeds these conventional blade holders would be so close to the paper web that they might easily impede circulation of the coating compound. In the embodiment according to FIG. 8 the slim blades have been clamped between lower collet jaws 11*a* and upper collet jaws 11*b*. The upper jaws 11*b* are longer than the jaws 11*a*. The thin blades 17 are therefore firmly clamped between the jaws 11*a* and 11*b* while at the same time resting against the upper edge 11*c* of the jaws 11*b*. It has been found in this embodiment that it is possible to combine good flexibility with the requirements for high specific pressure and slim blades so that a small phase width is obtained. In all the embodiments according to FIGS. 6, 7 and 8 slim, flexible blades 12; 16*a*; 17 respectively have been used to give good flexibility in spite of the need to counteract the considerable hydraulic pressure prevailing at high web speeds and viscous coating compounds in order to obtain the desired quantity applied.

Figure 9:
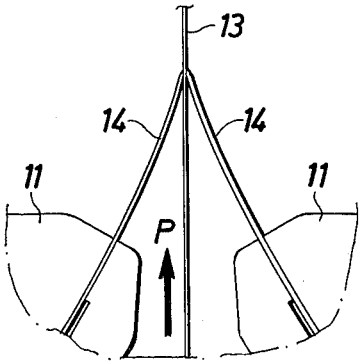
Figure 10:
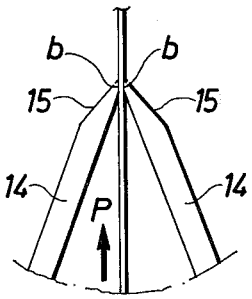

FIG. 9 shows an embodiment using relatively thick blades 14, but where the bevel width is small because the blade 14 has been ground in a special manner. It is easily understood that even if the blades 14 in FIG. 9 are relatively thick, they can be made sufficiently flexible by making the clamping length sufficiently long. In this embodiment also, therefore, great flexibility can be combined with high specific pressure in order to permit coating at high web speeds while still retaining the possibility of adjusting the quantity applied as desired. FIG. 10 shows an enlargement of the blade edges in the arrangement according to FIG. 9. The grinding on the outer side of the blades 14, i.e. the surfaces 15, enables the bevel width b to be maintained over a considerable running time in spite of wear, i.e. the quantity applied will remain the same even after a considerable time in use. Although the embodiments according to FIGS. 6, 7 and 8 are to be preferred, the embodiments according to FIGS. 9 and 10 have certain advantages, such as low manufacturing costs.

Table 2 below gives some examples of values measured and calculated when using the embodiments described with reference to FIGS. 6 to 10. In all cases steel blades have been used made of spring steel having an elastic modulus of between $2.1 \times 10^6$ kgf/cm$^2$ and $2.2 \times 10^6$ kgf/cm$^2$.

Many different qualities of paper were tested, some of them thin and relatively weak, but in spite of this it was possible to coat them even at extremely high web speeds without abnormal frequency of rupture and with extremely good quality for the coating.

TABLE 2

| Embodiments according to Figures | | 6 | 7 | 8 | 8 | 9/10 | 9/10 |
|---|---|---|---|---|---|---|---|
| Free blade length | mm | — | — | 8 | 5 | 40 | 40 |
| support length | mm | — | — | 15 | 15 | — | — |
| length of thin section | mm | 5 | 4 | — | — | — | — |
| length of thick section | mm | 25 | 25 | — | — | — | — |
| blade thickness | mm | — | — | 0.14 | 0.14 | 0.38 | 0.38 |
| blade thickness thin section | mm | 0.1 | 0.07 | — | — | — | — |
| thick section | mm | 0.38 | 0.40 | — | — | — | — |
| spring force F | kgf/cm | 0.13 | 0.13 | 0.10 | 0.12 | 0.12 | 0.13 |
| bevel width b | cm | 0.03 | 0.023 | 0.05 | 0.04 | 0.02 | 0.04 |
| edge angle | ° | 18 | 18 | 16 | 20 | 18 | 10 |

TABLE 2-continued

| Embodiments according to Figures | | 6 | 7 | 8 | 8 | 9/10 | 9/10 |
|---|---|---|---|---|---|---|---|
| spec. pressure | kgf/cm² | 4.3 | 5.7 | 2 | 2.9 | 6.0 | 3.2 |
| dryness content of compound | % | 60 | 62 | 59 | 58 | 60 | 56 |
| viscosity of compound | cp | 1800 | 1700 | 900 | 1500 | 1800 | 1000 |
| web speed | m/min | 700 | 850 | 300 | 500 | 900 | 600 |
| quantity applied | g/m² and side | 12 | 14 | 12 | 12 | 12 | 12 |

It has been found that irrespective of which embodiment according to the invention is selected out of those shown in FIGS. 6 to 10, with a bevel angle not exceeding 20°, if the speed is in excess of about 600 m/min. at a viscosity over about 100 cp for the coating compound, the bevel width should not exceed 0.04 cm. In the embodiments shown in FIGS. 6, 7 and 8 the blade thickness at the narrowest point should preferably not exceed 0.14 mm. In the embodiment shown in FIGS. 9 and 10 the blade thickness may naturally considerably exceed this value, but on the other hand the bevel width should not exceed 0.05 cm.

As mentioned earlier, the invention can be used irrespective of the manner in which the coating compound is applied on the paper web. This also applies to the methods or means by which the blades are caused to press against each other to give the necessary spring force. This can be achieved in many ways known per se, for instance by turning the blade holders toward each other, directing (i.e., linearly moving) them horizontally towards each other or by applying a load along the entire surface of the blade. One way of achieving this is to provide an inner, closed space between the opposing blades, which is separated from the surroundings, the atmosphere, the gas pressures inside and outside the space being different and thus providing the necessary pressure on the blades.

It has also been found that the present invention has an effect on the penetration of the liquid contained in the coating agent. For instance, the penetration of a size in water solution into the base paper will be considerably lower with the same quantities applied calculated as dry size and at the same concentration, if small bevel widths as proposed in accordance with the invention are used instead of traditional means. This is particularly useful if the coating agent, such as size, is to lie on the surface. It is especially important when coating paper webs with expensive surface treating agents in water solution. Considerable savings can be made in the form of reduced consumption of such chemicals since these can be concentrated at the surface and a certain surface effect can be obtained using less chemical. For instance, the consumption of chromium stearate can be considerably reduced when treating base paper for the manufacture of release paper, the reduction being estimated to 25% in comparison with a conventional treating of the paper in a sizing press, for instance, or with conventional blade coating to achieve a certain release effect. It should be pointed out that in this case the solutions of coating compounds do not necessarily having high viscosity, but the invention can be used with coating compounds having low viscosity such as low-viscosity water solutions.

I claim:

1. A method of coating both faces of a moving web, such as a paper web, comprising feeding the web longitudinally at a speed in excess of 200 meters per minute, applying a coating material to each face of the web, smoothing the coating material by means of two blades, one biased against each face, said blades each having a bevel at the point of contact with the web, controlling the angle of the blades so that they each extend at an angle less than 25° to the web and choosing the bevel width, measured in the direction of movement of the web, to be at most 0.08 centimeters, said blade being urged against the web with a force not exceeding 0.20 kgf per centimeter width of web.

2. In an apparatus for coating both faces of a moving web, such as a paper web, moving at a speed in excess of 200 meters per minute, in which coating material is applied to both faces and is smoothed out by means of two blades, one on each face of the web, the blades being thin and flexible and having a bevel at the point of contact with the web, the improvement consisting in that the bevel width, as measured in the direction of movement of the web, is at most 0.08 centimeters.

3. In an apparatus as claimed in claim 2, the improvement consisting in that the blade edge angle between the blade edge and the web is less than 25°.

4. In an apparatus as claimed in claim 2, the improvement consisting in that the apparatus further comprises means for pressing the blades into contact with the web with a spring force less than 0.20 kgf per centimeter width of web.

5. The apparatus of claim 2 wherein each said blade is formed of a first thick blade member; a support for holding one end of said thick blade member; a thin blade member secured to the free end of the thick blade member remote from said holder and having a thickness which is significantly less than the thickness of said thick blade member.

6. The apparatus of claim 5 wherein the thickness of each said thin blade member is preferably between 0.1 and 0.15 mm.

7. The apparatus of claim 2 wherein each said blade comprises a thick blade member; a holder for holding one end of said thick blade member; the free end of said thick blade member being machined so as to provide a portion of reduced thickness wherein said portion of reduced thickness is less than half the thickness of the remaining portion of said thick blade member.

8. The apparatus of claim 2 comprising a blade holder for each blade being provided with first and second holding members for clamping one end of said blade therebetween; one of said holding members having an end extending beyond one end of the remaining one of said holding members and in the direction of the free end of said blade so as to bear against the portion of said blade located beyond the clamped portion of the blade to increase the biasing force imparted upon the blade by the holder.

9. The apparatus of claim 2 further comprising means positioned intermediate the clamped end and the free end of each blade for imparting an additional biasing force upon the blade.

* * * * *

UNITED STATES PATENT AND TRADEMARK OFFICE

CERTIFICATE OF CORRECTION

PATENT NO. : 4,076,865

DATED : Feb. 28, 1978

INVENTOR(S) : Hans Ivar Wallsten

It is certified that error appears in the above-identified patent and that said Letters Patent are hereby corrected as shown below:

Column 4, TABLE 1, line 34, "and" should read --on each--.
Column 7, TABLE 2, line 10, "and" should read --on each--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*